United States Patent [19]

DiMarco

[11] 4,260,861

[45] Apr. 7, 1981

[54] HANDLE LOCKING MEANS FOR CIRCUIT BREAKER

[75] Inventor: Bernard DiMarco, Bellefontaine, Ohio

[73] Assignee: Gould Inc., Rolling Meadows, Ill.

[21] Appl. No.: 62,441

[22] Filed: Jul. 30, 1979

[51] Int. Cl.[3] ..... H01H 9/28

[52] U.S. Cl. ..... 200/42 T; 200/44

[58] Field of Search ..... 200/42 T, 44, 42 R

[56] References Cited

U.S. PATENT DOCUMENTS

| | | | |
|---|---|---|---|
| 3,291,924 | 12/1966 | Tharp | 200/42 T |
| 3,312,794 | 4/1967 | Hollyday | 200/42 T |
| 3,327,075 | 6/1967 | Phillipson | 200/42 T |

*Primary Examiner*—Willis Little

*Attorney, Agent, or Firm*—Harold Huberfeld; Jerome M. Berliner; Bernard Gerb

[57] ABSTRACT

This invention relates generally to handle locking attachments for circuit breakers and more particularly relates to handle locking attachments of the kind which receive padlocks.

12 Claims, 5 Drawing Figures

HANDLE LOCKING MEANS FOR CIRCUIT BREAKER

BACKGROUND OF THE INVENTION

U.S. Pat. No. 3,595,040 issued July 27, 1971 to R. D. Curl for a Handle Lock Attachment discloses a device which is securable to a molded case circuit breaker and is capable of receiving a padlock to maintain the elements of the lock attachment in operative position to limit movement of the circuit breaker operating handle. The handle lock attachment of the aforesaid Curl patent is secured to the circuit breaker housing by utilizing four screws which extend into apertures in the circuit breaker housing located around the periphery of the aperture through which the circuit breaker operating handle extends. Since the fastening screws are threaded directly into the molded housing of the circuit breaker it is relatively easy to rip the entire handle lock attachment from the circuit breaker and thereby defeat the intended purpose of the attachment.

The prior art has attempted to provide handle lock attachments that are mounted directly to molded case circuit breakers without utilizing fasteners, such as screws, which are driven into the molded housing. One such prior art attempt is illustrated in co-pending U.S. patent application Ser. No. 865,224, filed Dec. 28, 1977 entitled Bracket Means To Mount A Padlock For Blocking Movement of A Switch Handle, with R. C. Clement and W. R. Latimer as coinventers, and assigned to the assignee of the instant invention.

A drawback of the device of the aforesaid co-pending application Ser. No. 865,224 is that the circuit breaker must be constructed with particularly shaped and positioned undercuts which receive portions of the handle lock attachment. Further, the attachment must be manufactured to relatively close tolerances.

SUMMARY OF THE INVENTION

In order to overcome the foregoing disadvantages of prior art handle lock attachments, the instant invention provides a handle lock attachment of the type which does not require fasteners that are driven directly into special apertures provided in the circuit breaker housing nor does it require the circuit breaker housing to be constructed with special formations which are engaged to secure the handle lock attachment to the circuit breaker housing. Instead, the instant invention provides a handle lock attachment which is secured to the circuit breaker housing merely by taking advantage of the fact that the circuit breaker housing is provided with an elongated aperture through which the circuit breaker manual operating handle extends. In particular, the handle lock attachment of the instant invention includes pivotally connected frame members each having a hook formation that extends through the handle aperture and engages the end boundaries thereof to secure the attachment to the circuit breaker housing. A blocking member secured to the frame members is provided to assure that a padlock may not be received by the attachment while the circuit breaker handle is in the On position. When the latter condition prevails, the blocking member may be moved from its inactive position to an active position by sliding by the blocking member relative to the frame members. With the blocking member in its active position, padlock apertures in the blocking member and both of the frame members are in alignment to receive the bail of a padlock and position the latter to prevent movement of the circuit breaker handle to its On position.

Accordingly, a primary object of the instant invention is to provide a novel improved handle lock attachment mountable to the housing of a circuit breaker.

Another object is to provide a handle lock attachment of this type which is securable to the circuit breaker housing without the necessity of utilizing fasteners driven into apertures in the circuit breaker housing.

Still another object is to provide a handle lock attachment of this type which utilizes the handle aperture of the circuit breaker housing for securement of the attachment to the circuit breaker housing.

A further object is to provide a handle lock attachment which is constructed as a subassembly including pivotally connected frame members movable between hold and release positions, and a blocking member slidably mounted to the frame members for movement between active and inactive positions.

A still further object is to provide a handle lock attachment of this type having means to prevent insertion of a padlock bail so long as the circuit breaker handle is in its On position.

These objects as well as other objects of this invention shall become readily apparent after reading the following description of the accompanying drawings in which.

Figure 3:
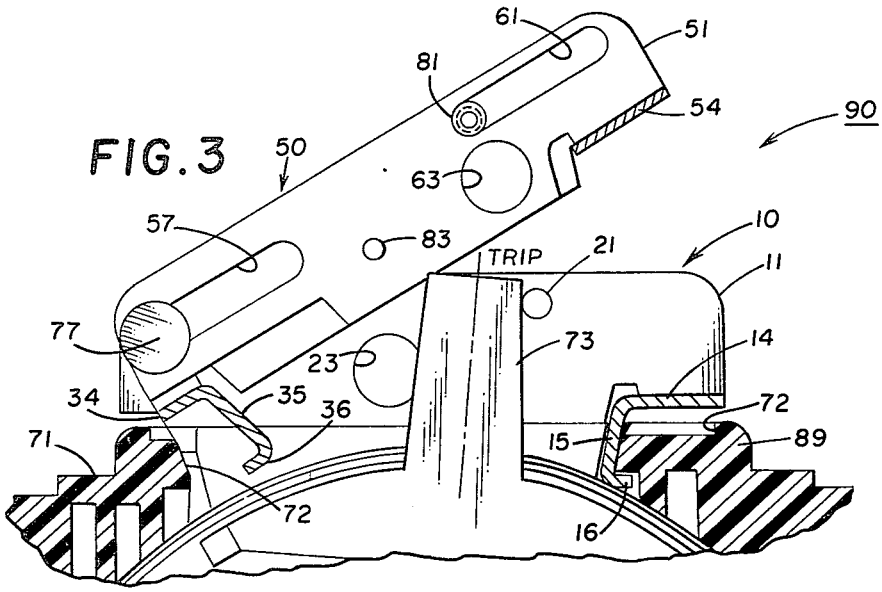
Figure 4:
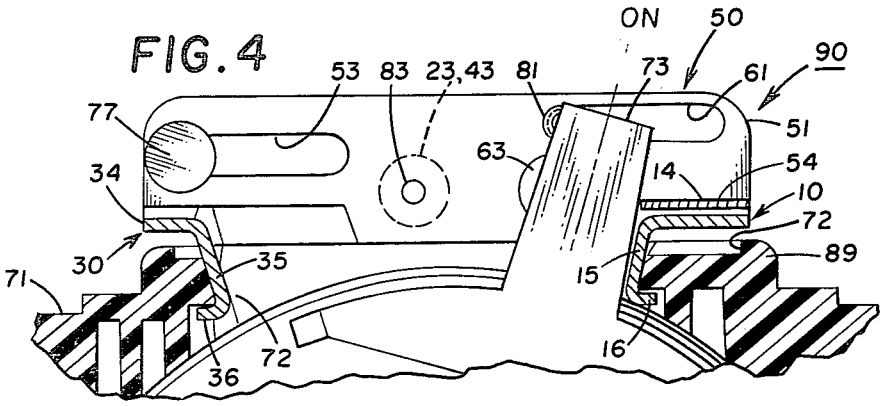
Figure 5:
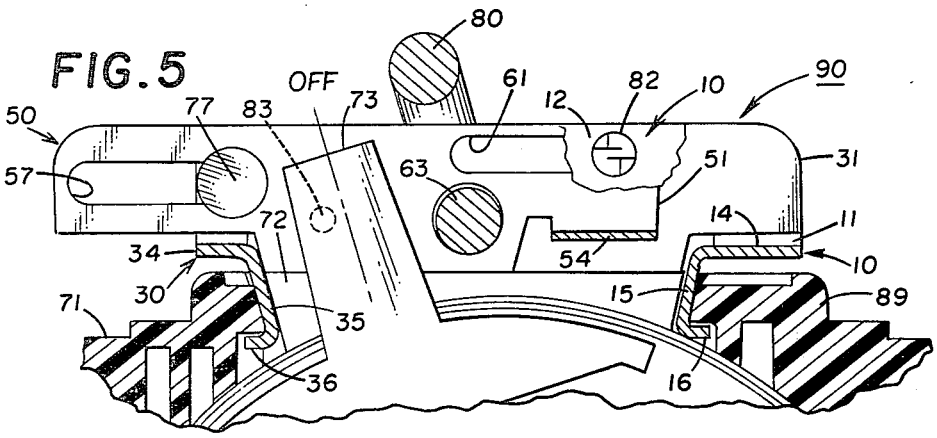

FIGS. 3, 4 and 5 are longitudinal cross-sections showing the relationship between the handle lock attachment and the circuit breaker housing. In FIG. 3 the attachment is in the process of being secured to the circuit breaker and the operating handle of the circuit breaker is in Tripped position. In FIG. 4 the circuit breaker handle is in the On or closed contact position and the blocking member of the locking attachment is in its inactive position. In FIG. 5 the circuit breaker handle is in the Off or contact open position and the blocking member is in its active position, a padlock bail is shown extending through aligned apertures of the attachment.

DETAILED DESCRIPTION OF THE DRAWINGS

Now referring to the Figures. Handle lock attachment 90 of the instant invention is constructed of three sheet metal members, namely frame members 10 and 30, and blocking member 50. Frame member 10 is generally U-shaped consisting of spaced parallel arms 11, 12 connected by web 14. The latter is disposed in a plane parallel to the front surface 71 of a circuit breaker housing while arms 11, 12 are in planes perpendicular to and extending forward of the plane of web 14. The other frame member 30 is also generally U-shaped including spaced parallel arms 31, 32 connected by web 34. The latter is in a plane parallel to the plane of web 14 and arms 31, 32 are in planes perpendicular to the plane of web 34 and extending forward thereof. For reasons which will hereinafter be seen, along one edge thereof web 14 is provided with rearward extension 15 having a hook-like edge projection 16. Similarly, web 34 along one edge thereof is provided with rearward extension 35 having hook-like projection 36 along one edge thereof. Blocking member 50 is also generally U-shaped, including spaced parallel arms 51, 52 connected by web 54 which is in a plane at right angles to the planes of arms 51, 52 and generally at the rear thereof.

Aligned apertures 17, 18 at the ends of arms 11, 12 remote from web 14 received the respective rivets 77, 78 which also extend through aligned apertures 37, 38 at the ends of the respective arms 31, 32 having web 34. Rivets 77, 78 also extend through aligned elongated slots 57, 58 extending longitudinally of the respective arms 51, 52. Hollow embossments 41, 42 project inwardly from the respective arms 31, 32 and are received by longitudinally extending elongated slots 61, 62, respectively, in arms 51, 52. Thus, it is seen that rivets 77, 78 form a pivot axis about which the combination of frame member 30 and blocking member 50 is pivotable as a unit with respect to frame member 10. In addition, rivets 77, 78 in cooperation with slots 57, 58 slidably mount blocking member 50 to frame member 30. This sliding movement is further guided by embossments 41, 42 in cooperation with slots 61, 62.

In order to mount attachment 90 to the circuit breaker housing, combination 30, 50 is pivoted counterclockwise to the position of FIG. 3 wherein frame member 30 is in its release position relative to frame member 10. Extensions 15, 35 are then moved rearward through handle aperture 72 and hook-like formation 16 is moved to the right with respect to FIG. 3, moving behind the front wall 89 of the circuit breaker housing. Thereafter subassembly 30, 50 is pivoted clockwise from the position of FIG. 3 to that of FIG. 4 thereby bringing hook-like formation 36 behind front wall 89 at the other end of handle opening 72. Web extensions 15, 35 are substantially the width of handle opening 72 so that handle lock attachment 90 cannot move sideways in opening 72. With the elements in the position of FIG. 4 extensions 15, 35 prevent endwise movement of attachment 90 and hook-like formations 16, 36 prevent forward movement of attachment 90.

With the elements of attachment 90 in the position of FIG. 4, blocking element 50 is to the right or in its inactive position wherein contact operating handle 73 may be moved freely from one end to the other of opening 72. Handle 73 is manually operable between the circuit breaker Off position of FIG. 5 and the circuit breaker On position of FIG. 4. When the circuit breaker is tripped automatically because a fault current condition is sensed, handle 73 assumes the tripped or intermediate position of FIG. 3. Frame members 10, 30 are maintained in the relative hold position of FIGS. 4 and 5 by one way screws 81, 82 which extend through respective clearance apertures 21, 22 in arms 11, 12 and are threadably received by hollow extrusions 41, 42, respectively.

Figure 1:
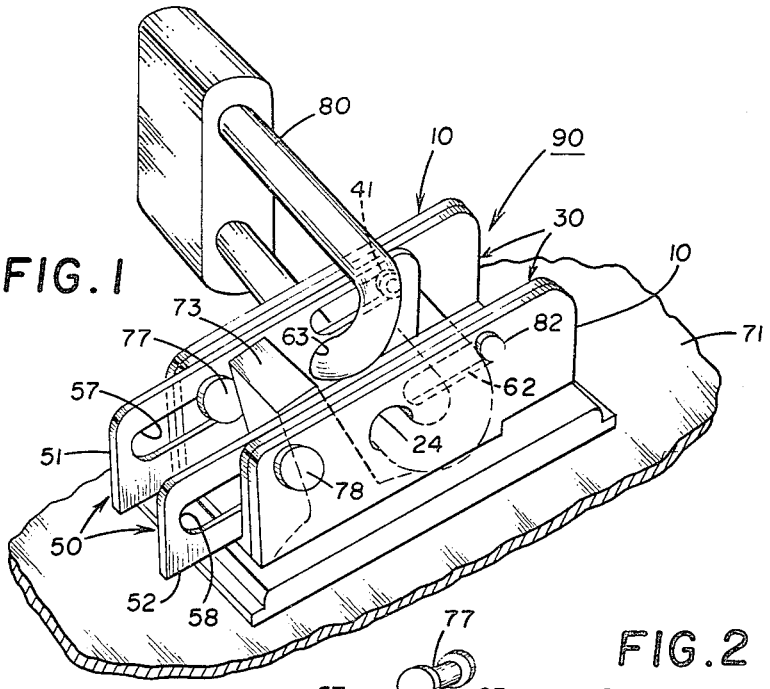
FIG. 1 is a perspective illustrating the handle lock attachment of the instant invention secured to a circuit breaker housing.

With frame members 10, 30 in the hold position, lock receiving apertures 23, 24 are aligned with the respective apertures 43, 44. However, until blocking member 50 is moved to its active position of FIG. 5 wherein lock receiving apertures 63, 64 are aligned with apertures 23, 24, 43, 44, apertures 23, 24, 43, 44 are effectively blocked by portions of arms 51, 52 so that a padlock cannot be mounted to attachment 90 at this time. When circuit breaker handle 73 is in the On position of FIG. 4 interference between handle 73 and web 54 of blocking member 50 prevents the latter from being moved to its active position of FIG. 5. However, when circuit breaker handle 73 is moved to its Off position of FIG. 5, blocking member 50 is permitted to slide from its inactive position of FIG. 4 to its active position of FIG. 5, wherein apertures 63, 64 are aligned with apertures 23, 24, 43, 44. Now padlock bail 80 may be inserted through aligned apertures 63, 43, 23 (as in FIG. 1). Since arms 51, 52 of blocking member 50 are close to the sides of handle 73, bail 80 is operatively positioned to block operation of circuit breaker handle 73 to the On position of FIG. 4. With blocking member 50 in its active position, another lock bail (not shown) may be inserted through the other set of aligned apertures 24, 44, 64 to also block operation of handle 73 to the On position. If a single lock bail is long enough (as shown in phantom in FIG. 1) it may be extended through all six apertures 23, 24, 43, 44, 63, 64.

Figure 2:
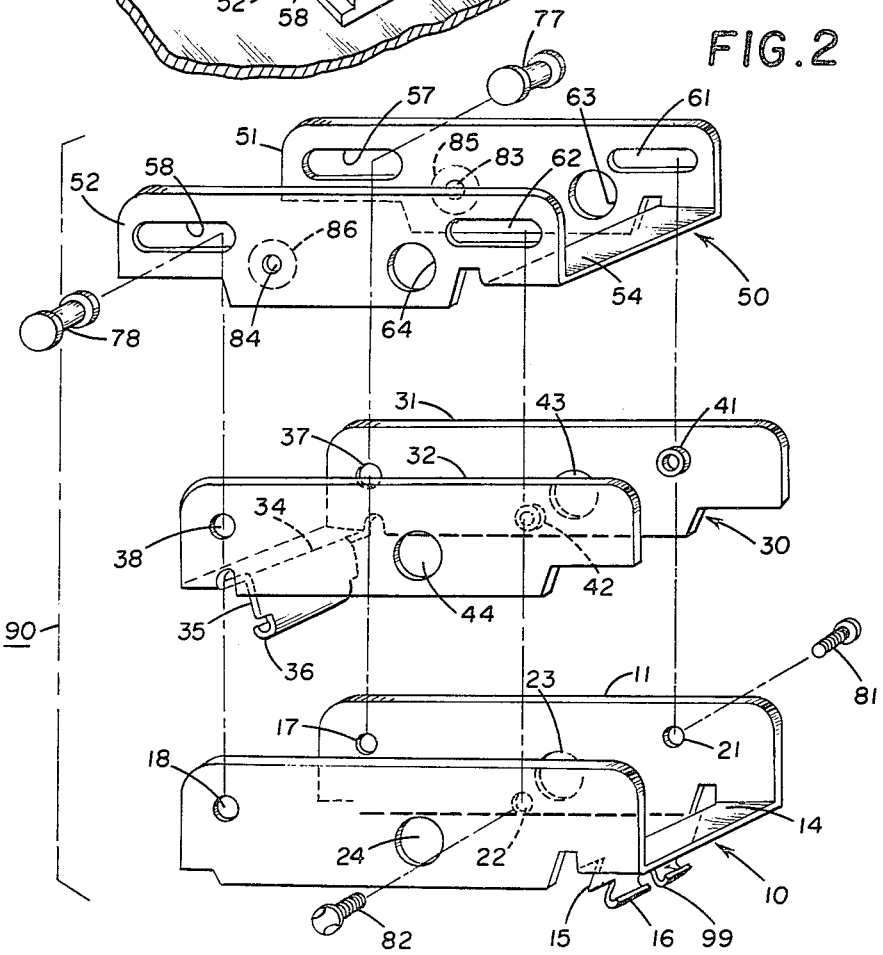
FIG. 2 is an exploded perspective of the handle lock attachment elements.

Aligned apertures 83, 84 in the respective arms 51, 52 are pilot holes which locate and facilitate drilling of apertures 85, 86 shown in phantom in FIG. 2. With apertures 85, 86 present operation of blocking member 50 to its inactive position of FIG. 4 aligns apertures 85, 86 with apertures 23, 24 43, 44 for mounting of one or two padlocks so that the bails thereof will block movement of handle 73 from the On to Off positions of FIGS. 4 and 5, respectively.

Hook-like formation 16 is provided with central keying notch 99 (FIG. 2) which receives a keying protrusion (not shown) formed in the circuit breaker housing at the boundary of handle aperture 72. Notch 99 and said keying protrusion ensure that attachment 90 will be mounted properly (for locking handle Off).

On the other hand, if handle locking only in the On position is desired, then attachment 90 is pivoted 180° so that pivots 77, 78 are positioned at the right with respect to FIGS. 3-5 and web 54 is positioned at the left with respect to FIGS. 3-5. However, in order to achieve this optional mounting, the aforesaid keying protrusion cannot be present or else hook-like formation 36 must also be provided with a central notch (not shown) corresponding to notch 99.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A handle locking attachment for use with a switch including a housing and a contact operating handle extending externally of the housing through a front opening thereof and reciprocable parallel to the sides of the opening between the ends thereof, to open and closed contact positions; said attachment including frame means and a blocking member mounted on said frame means for movement between inactive and active positions; said frame means and said blocking member each having lock aperture means which are aligned when said blocking member is in said active position to receive and position a lock bail to prevent movement of the operating handle between its open and closed contact positions when said attachment is operatively secured to the housing; said frame means including first and second frame members mounted to each other and relatively movable to hold and release positions for respectively mounting and dismounting said attachment on the switch; said first and second frame members including respective first and second formations which extend rearward through the opening at opposite ends thereof; said first and second formations along the rear thereof including respective first and second projections facing away from each other to secure the attachment to a switch when the frame members are in said hold position; securing means engageable with said frame means to maintain said frame members in said hold position; and pivot means defining a pivot axis about which said frame members move between said hold and release positions and providing a sliding connection along which said blocking member moves between said active and inactive positions.

2. A handle locking attachment as set forth in claim 1 in which the blocking member includes a blocking formation operatively positioned to prevent movement of the blocking member to said active position when the handle is in closed contact position; said blocking member being maintained in said active position by a lock bail extending through said lock aperture means of said blocking member and said frame means.

3. A handle locking attachment as set forth in claim 1 in which each of the frame members is U-shaped including first and second arms connected at their first ends by a transverse web; said first and second formations extending from the webs of the respective first and second frame members; said lock aperture means being in said arms of the first and second frame members.

4. A handle locking attachment as set forth in claim 3 in which the blocking includes spaced first and second arms connected by a transverse web operatively positioned to prevent movement of the blocking member to said active position when the handle is in one of its open and closed contact positions; said blocking member being maintained in said active position by a lock bail extending through said lock aperture means of said blocking member and said frame means.

5. A handle locking attachment as set forth in claim 4 in which the arms extend generally parallel to the sides of the aperture and are disposed in planes perpendicular to said pivot axis; said webs being disposed in planes perpendicular to said planes of said arms; said arms extending forward of said webs.

6. A handle locking attachment as set forth in claim 5 in which the arms of the first frame member are inboard of the arms of the second frame member and adjacent thereto.

7. A handle locking attachment as set forth in claim 6 in which the arms of the blocking member are inboard of the arms of the first frame member and adjacent thereto.

8. A handle locking attachment as set forth in claim 7 in which the pivot means includes pin means defining said pivot axis; said sliding connections being defined by slots in said arms of said blocking member cooperating with said pin means which extends through said slots; said slots being elongated and extending lengthwise of said arms of said blocking member.

9. A handle locking attachment as set forth in claim 5 in which the lock aperture means includes a first pair of aligned apertures in the arms of said first frame member; a second pair of aligned apertures in the arms of said second frame member and a third pair of aligned apertures in the arms of the blocking member; with said frame members in said hold position and said blocking member being in said active position said apertures of said first, second and third pairs of apertures being aligned to receive lock bail means and position the latter to block movement of the handle from one end of the aperture to the other end thereof.

10. A handle locking attachment as set forth in claim 4 in which the pivot axis and the transverse web are disposed near opposite ends of the frame means.

11. A handle locking attachment as set forth in claim 5 in which said first arms are at one side of said opening and said second sides are at the other side of said opening.

12. A handle locking attachment as set forth in claim 1 in which one of said first and second formations is provided with a keying formation to receive a cooperating keying formation of a switch housing for properly positioning said attachment on a switch housing.

* * * * *

UNITED STATES PATENT AND TRADEMARK OFFICE

CERTIFICATE OF CORRECTION

PATENT NO. : 4,260,861

DATED : April 7, 1981

INVENTOR(S) : Bernard DiMarco and Andrew J. Kralik

It is certified that error appears in the above-identified patent and that said Letters Patent are hereby corrected as shown below:

In the cover page, please change "DiMarco" to --DiMarco et al.-- ; and

In item 75, please add the name of the following inventor --Andrew J. Kralik, Marysville, Ohio--.

Signed and Sealed this

*Fifth* Day of *January 1982*

[SEAL]

*Attest:*

GERALD J. MOSSINGHOFF

*Attesting Officer*

*Commissioner of Patents and Trademarks*